US006374952B2

(12) United States Patent
Itoh et al.

(10) Patent No.: US 6,374,952 B2
(45) Date of Patent: Apr. 23, 2002

(54) ELEVATOR DOOR APPARATUS

(75) Inventors: Hideki Itoh, Yokohama; Keiko Ozawa, Hachioji, both of (JP)

(73) Assignee: Otis Elevator Company, Farmington, CT (US)

( * ) Notice: Subject to any disclaimer, the term of this patent is extended or adjusted under 35 U.S.C. 154(b) by 4 days.

(21) Appl. No.: 09/732,415

(22) Filed: Dec. 7, 2000

(30) Foreign Application Priority Data

Dec. 10, 1999 (JP) ..... 11-351002

(51) Int. Cl.[7] ..... B66B 13/06; B66B 13/20

(52) U.S. Cl. ..... 187/319; 187/330; 187/335; 49/120

(58) Field of Search ..... 187/319, 330, 187/307, 308, 309, 335; 49/120, 116, 117, 119

(56) References Cited

U.S. PATENT DOCUMENTS 5,005,673 A * 4/1991 Rivera ..... 187/330
6,021,871 A * 2/2000 Grabner ..... 187/335

* cited by examiner

*Primary Examiner*—Eileen D. Lillis
*Assistant Examiner*—Thuy V. Tran

(57) ABSTRACT

A car cam and locking roller locking structure that opens and closes elevator doors so that the lateral sliding of the car will not affect the opening of the doors. The invention is a mechanism to open and close elevator doors that is used to start the opening and closing operation of car door (1) and boarding entrance door (13) by moving forward end (4a) of car cam (4) furnished for car door (1) forward between a pair of locking rollers (14a) and (14b) furnished for boarding entrance door (13) so that it nearly touches locking roller (14a), while at the same time moving the other locking roller (14b) to grip car cam (4). Step-shaped part (40) is formed in locking roller (14b), and at the same time, catch (50), which catches the step-shaped part (40) to prevent its coming loose, is formed in car cam (4).

4 Claims, 6 Drawing Sheets

ELEVATOR DOOR APPARATUS

FIELD OF THE INVENTION

The present invention pertains to an elevator door apparatus which opens the car door and the boarding entrance door when the elevator car arrives at a floor.

BACKGROUND

When an elevator car arrives at a floor, to open and close the car door and the boarding entrance door, a car cam installed on the car door engages with a locking roller installed on the boarding entrance door. When the car door is opened by a door operator installed on the car, the boarding entrance door is opened via the aforementioned car cam and locking roller.

As shown in FIG. 11, a door hanger (2) is installed at the top of car door (1). Said door hanger (2) is suitably supported so that it can slide freely on a door guide (not shown in the figure) via a roller (3). A support part (6) with a pin (5) is installed on door hanger (2). A car cam (4), which has an L-shaped cross section and a T-shaped end part that projects vertically, is supported in a freely-rocking manner by said pin (5).

As shown in FIG. 12, said car cam (4) is positioned in a notched part (2*a*) formed on door hanger (2). Car cam (4) is able to rock through said notched part (2*a*). The impelling force of spring (7) installed on pin (5) is applied to car cam (4). Under the impelling force, car cam (4) rotates counterclockwise in FIG. 12. The end part (4*a*) of car cam (4) is positioned between a pair of stoppers (8) and (9) formed on door hanger (2). Stopper (8) stops the clockwise rotation of car cam (4) at a prescribed position, while stopper (9) stops the counterclockwise rotation at a prescribed position.

Also, a roller locking part (10), which has an almost v cross section shape, is formed integrally on the inner side of car cam (4) (top side in FIG. 12). A press roller (11) is bought into contact with said roller locking part (10). Said press roller (11) is installed on a support part (12). When the press roller is moved in the direction indicated by arrow A together with support part (12), it presses against roller locking part (10) to rotate car cam (4) in the direction indicated by arrow B about pin (5) against the impelling force of spring (7). As a result, the end part (4*a*) projects from the space between stoppers (8) and (9). In this way, as shown in FIG. 13, the end part (4*a*) of car cam (4) enters and is locked between a pair of locking rollers (14*a*) and (14*b*) installed on boarding entrance door (13).

Support part (12) that supports press roller (11) is fastened to an endless belt (15) used for door opening. As shown in FIG. 11, said endless belt (15) is wound around driven pulley (16) and drive pulley (17), and drive pulley (17) is rotated by motor (18). Also, support part (12) is engaged in a freely sliding manner with a guide rail (19) which is arranged in the opening/closing direction of door (1).

On the other hand, locking rollers (14*a*) and (14*b*) are installed on the opening/closing apparatus of boarding entrance door (13). As shown in FIG. 14, a door unlocking lever (31), where locking roller (14*a*) is pivoted, is supported in rotatable manner by shaft (32) on base bracket (30) which is supported in a rotatable manner on the opening/closing apparatus. Also, locking roller (14*b*) is supported in a rotatable manner on the shaft (35) of disk (34) supported in a rotatable manner by shaft (33) on base bracket (30). Disk (34) is actuated to rotate by a coil spring (36) installed between the disk and base bracket (30). Also, a cam releasing roller (37) is supported in a freely rotatable manner by shaft (29) on disk (34). A locking recessed part (38) is formed at one end of door unlocking lever (31). A key (39) formed in the fixed part on the side of the opening/closing apparatus can be engaged or disengaged in said locking recessed part (38) to lock or unlock said boarding entrance doors (13), (13).

When endless belt (15) is rotated in the direction indicated by arrow A under the driving of motor (18), press roller (11) first presses against roller locking part (10). As a result, car cam (4) rotates together with roller locking part (10) in the direction indicated by arrow B. The rotation is stopped by stopper (8).

At that time, as shown in FIG. 13, the end part (4*a*) of car cam (4) is positioned between a pair of locking rollers (14*a*) and (14*b*) installed on boarding entrance door (13). When car cam (4) moves between locking rollers (14*a*) and (14*b*), as shown in FIG. 15, said clearance c is formed between the car cam and locking roller (14*a*) as the car cam moves away from locking roller (14*b*). When car cam (4) is bought into contact with locking roller (14*a*) to press locking roller (14*a*) in the direction indicated by the arrow, door unlocking lever (31) rotates about shaft (32), and its locking recessed part (38) moves away from key (39) to unlock boarding entrance doors (13), (13). When car cam (4) continues its movement to further press locking roller (14*a*), base bracket (30) starts to move and comes into contact with a projecting part formed on the opening/closing apparatus to kick cam releasing roller (37). As a result, disk (34) is rotated around shaft (33) under the force of coil spring (36). In this way, as shown in FIG. 16, locking roller (14*b*) comes into contact with car cam (4), and car cam (4) is sandwiched between locking rollers (14*a*) and (14*b*).

Subsequently, press roller (11) comes into contact with the end portion of roller locking part (10) and stops there. Car door (1) is opened from the opening/closing center shown on the left side in the figure to the right side in the figure. In the meantime, boarding entrance door (13) is also opened via car cam (4) and locking roller (4*a*).

In the aforementioned conventional elevator, as shown in FIG. 12, when endless belt (15) moves in the direction indicated by arrow A, car cam (4) rotates around pin (5) in the direction indicated by arrow B. As shown in FIG. 13, the end part (4*a*) moves into the space between locking rollers (14*a*) and (14*b*). Locking roller (14*b*) approaches locking roller (14*a*) to sandwich car cam (4) between them. When car cam (4) moves along with the movement of endless belt (15), locking roller (14*a*) also moves. In this way, car door (1) and boarding entrance door (13) can be opened. In this case, however, only a small portion of the end part (4*a*) is in contact with locking roller (14*a*).

Consequently, when the car shakes (for example, when people step quickly into the elevator causing it to shake significantly), there is a high probability that the car cam will slip out of the space between locking rollers (14*a*) and (14*b*). In this case, boarding entrance door (13) equipped with an automatic locking apparatus will be closed suddenly when car door (1) starts to open.

The purpose of the present invention is to solve the aforementioned problem by providing an elevator door apparatus which improves the locking structure between the car cam and the locking roller so that the car cam will not become disengaged easily from the locking roller no matter how hard the elevator car shakes.

DISCLOSURE OF THE INVENTION

In order to realize the aforementioned purpose, of the present invention provides an elevator door apparatus characterized by the following facts: the elevator door apparatus is used to start the opening/closing operation of the car door and boarding entrance door by moving the end part of a car cam installed on the car door into the space between a pair of locking rollers installed on the boarding entrance door so that it almost touches a locking roller, while at the same time moving the other locking roller to grip the car cam; in this elevator door apparatus, a step-shaped part is formed on the aforementioned movable locking roller, and a catch which engages with the aforementioned step-shaped part is formed on the car cam.

In a second embodiment, the catch is formed by obliquely bending the end part of a metal plate that is superposed with the aforementioned car cam, and the end part can make sliding contact with the step-shaped part with or without an inclined surface formed on the aforementioned locking roller. In a further embodiment, the catch is formed by almost perpendicularly bending the end part of a resin plate bonded to the end part of the aforementioned car cam, and the end part of the resin plate can make sliding contact with the step-shaped part with or without an inclined surface formed on the aforementioned locking roller.

Consequently, when the car cam moves into the space between the locking rollers and one of the locking rollers moves toward the other locking roller to grip the car cam, the catch of the car cam engages with the step-shaped part formed on the movable locking roller to fasten the car cam. In this way, the car cam will not slip out of the locking rollers no matter how hard the elevator car shakes. Also, the car door and the boarding entrance door can be opened smoothly.

BEST MODE FOR CARRYING OUT THE INVENTION

In the following, the present invention will be explained in more detail with reference to the application example shown in the figures. In order to facilitate the explanation, the same names or symbols are assigned to the same or corresponding parts that appear in the aforementioned conventional example. The present invention is designed to improve the locking rollers installed on the boarding entrance door and the car cam installed on the car door.

Figure 1:
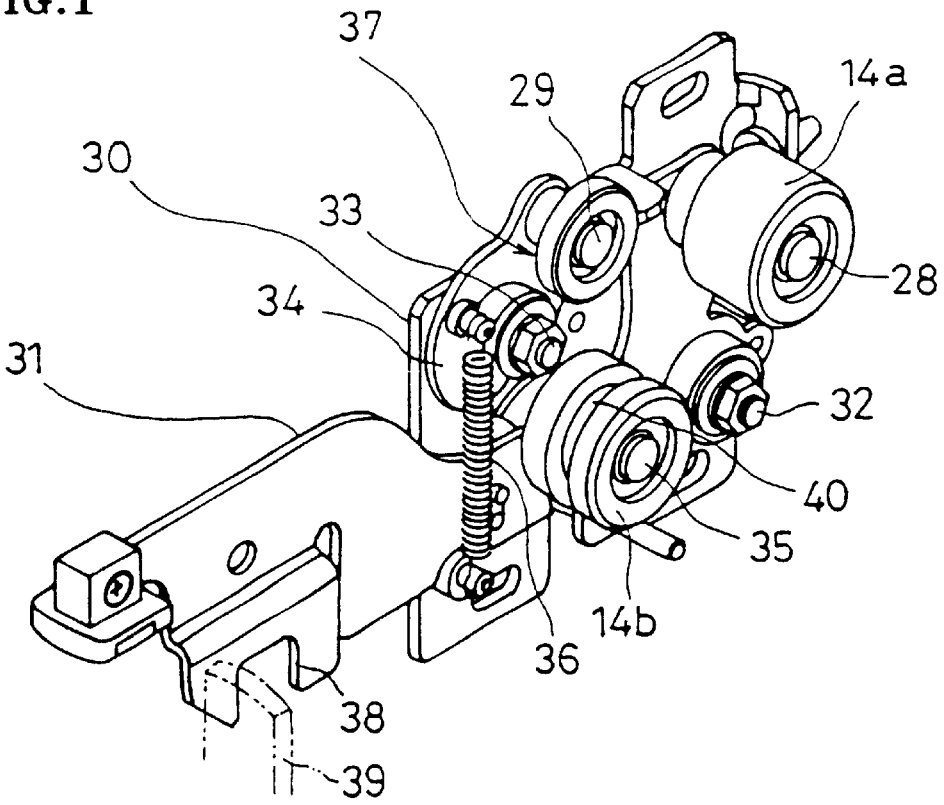
FIG. 1 is an oblique view illustrating the main parts of the elevator door apparatus disclosed in the present invention.
Figure 2:
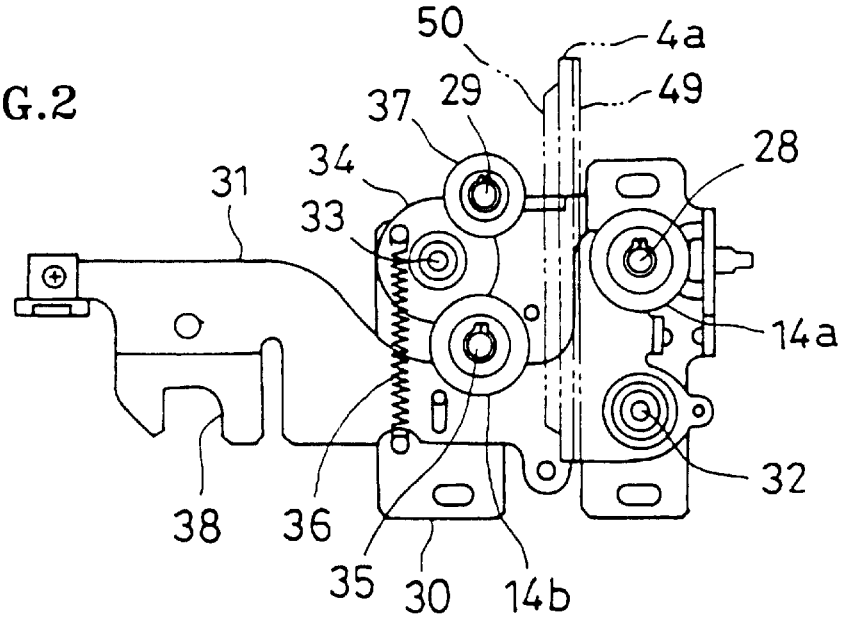
FIG. 2 is a front view of the elevator door apparatus.

For locking rollers (14*a*) and (14*b*), as shown in FIGS. 1 and 2, door unlocking lever (31) where locking roller (14*a*), pivoted with shaft (28), is supported in a rotatable manner with shaft (32) on base bracket (30), which is supported in a rotatable manner on the opening/closing apparatus of boarding entrance door (13). Also, locking roller (14*b*) is supported in a rotatable manner by shaft (35) of disk (34), which is supported in a rotatable manner by shaft (33) on base bracket (30). Disk (34) is actuated to rotate by coil spring (36) installed between the disk and base bracket (30).

Also, cam releasing roller (37) is pivoted in a freely rotatable manner by shaft (29) on disk (34). A locking recessed part (38) is formed at one end of door unlocking lever (31). A key (39) formed in the fixed part on the side of the opening/closing apparatus can be engage or disengage with said locking recessed part (38) to lock or unlock said boarding entrance doors (13), (13).

Figure 4:
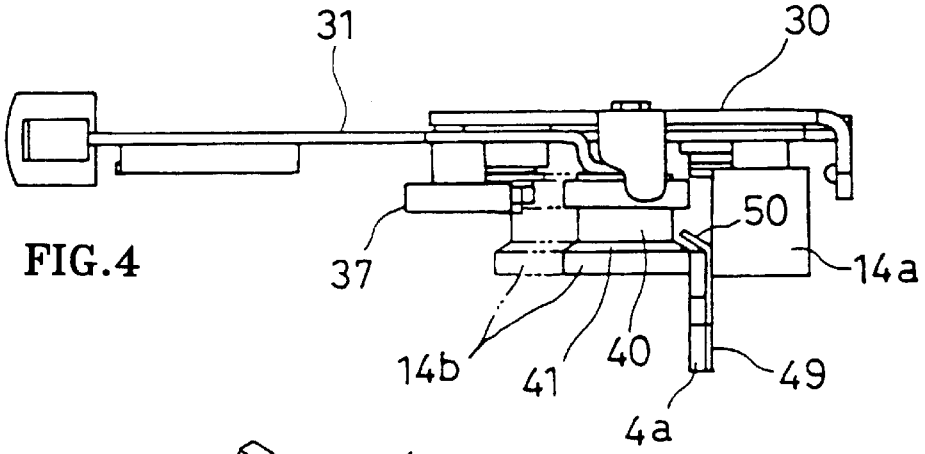
FIG. 4 is an operation plan view of the elevator door apparatus.

A step-shaped part (40) is formed on locking roller (14*b*). As shown in FIG. 4, an inclined surface (41) is formed on said step-shaped part (40). The reason for forming step-shaped part (40) and inclined surface (41) on locking roller (14*b*) is to avoid the problem that might occur when car cam (4) is moved away from locking roller (14*a*) if the step-shaped part and inclined surface are formed on locking roller (14*a*).

Figure 5:
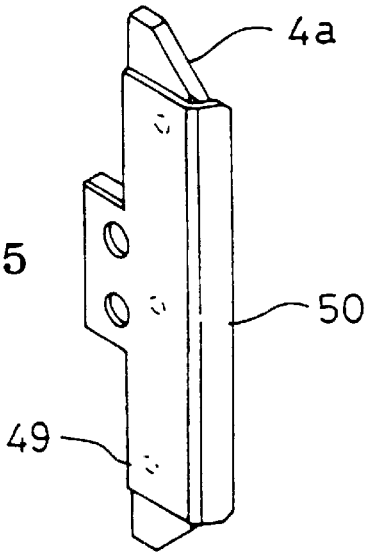
FIG. 5 is an oblique view illustrating the end part of the car cam disclosed in the present invention.
Figure 8:
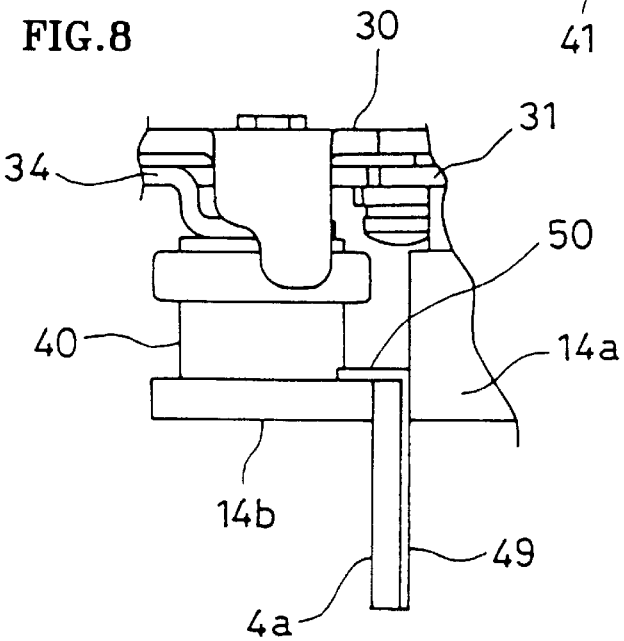
FIG. 8 is a partially enlarged view illustrating another example of the car cam and the locking rollers.

On the other hand, as shown in FIG. 5, a metal plate (49), which is thinner than car cam (4) itself, is laminated and fixed on the end part of car cam (4) by means of spot welding, etc.. The end part of metal plate (49) is bent perpendicularly or obliquely toward locking roller (14*b*) to form catch (50). Said catch (50) can be bought into contact with inclined surface (41). As shown in FIG. 8, it is also possible to form the catch (50) by bending metal plate (49) almost perpendicularly.

Figure 9:
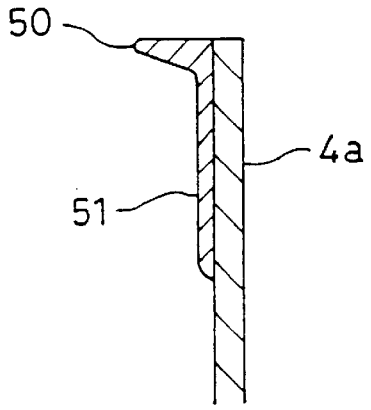
FIG. 9 is a side cross-sectional view illustrating another example of the car cam.
Figure 10:
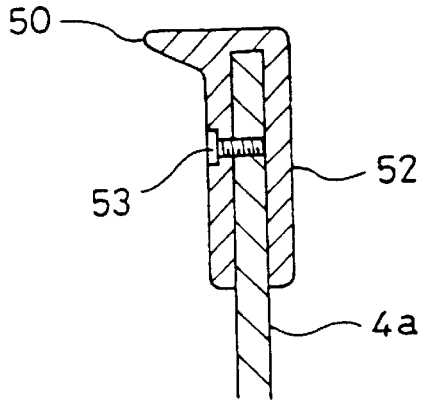
FIG. 10 is a side cross-sectional view illustrating another example of the car cam.
Figure 11:
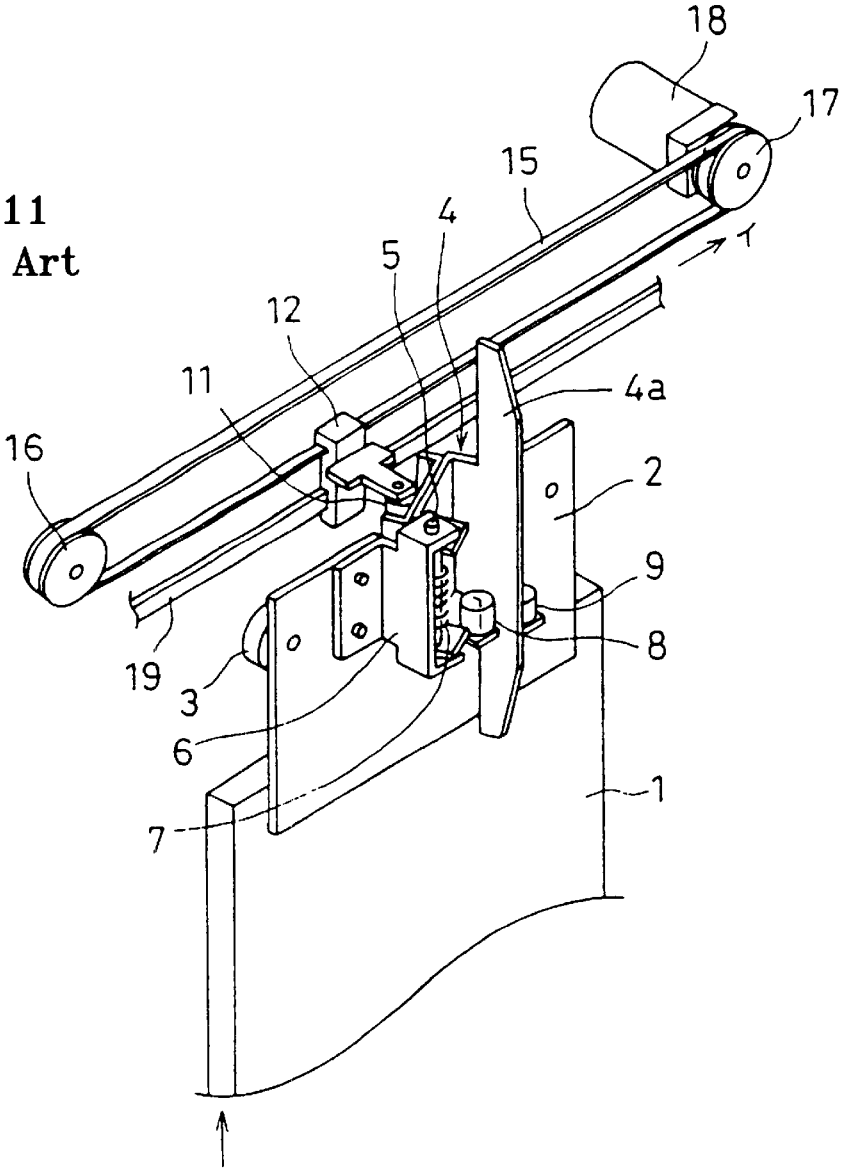
FIG.11 Prior Art
FIG. 11 is an oblique view illustrating a prior art car cam installed on car door.
Figure 12:
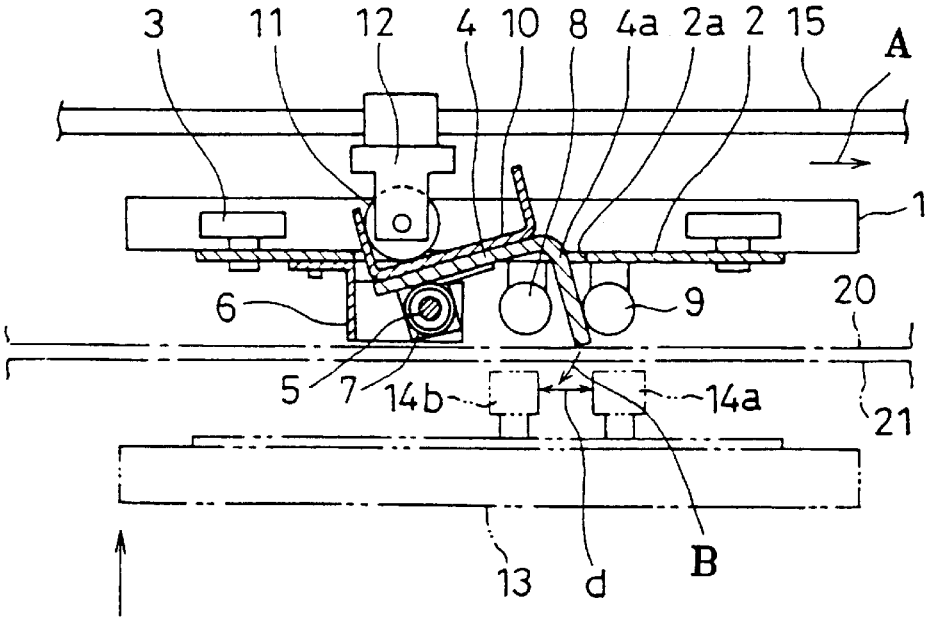
FIG.12 Prior Art
FIG. 12 is a plan view of car door and boarding entrance door illustrating the function of the car cam with the aid of the prior art locking rollers.
Figure 13:
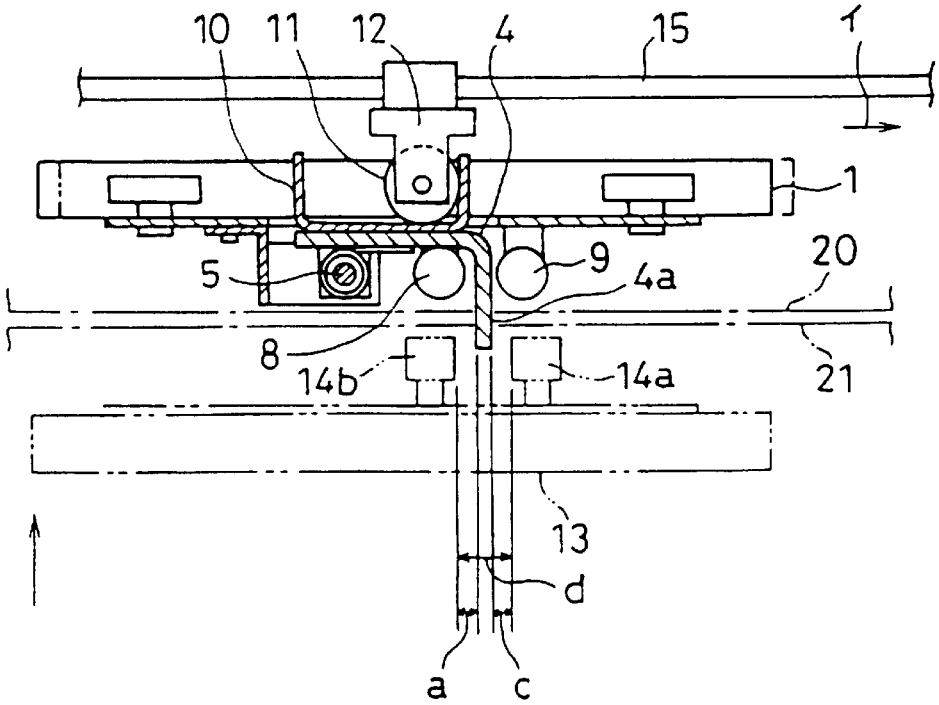
FIG.13 Prior Art
FIG. 13 is a plan view of car door and boarding entrance door illustrating the function of the car cam with the aid of the prior art locking rollers.
Figure 14:
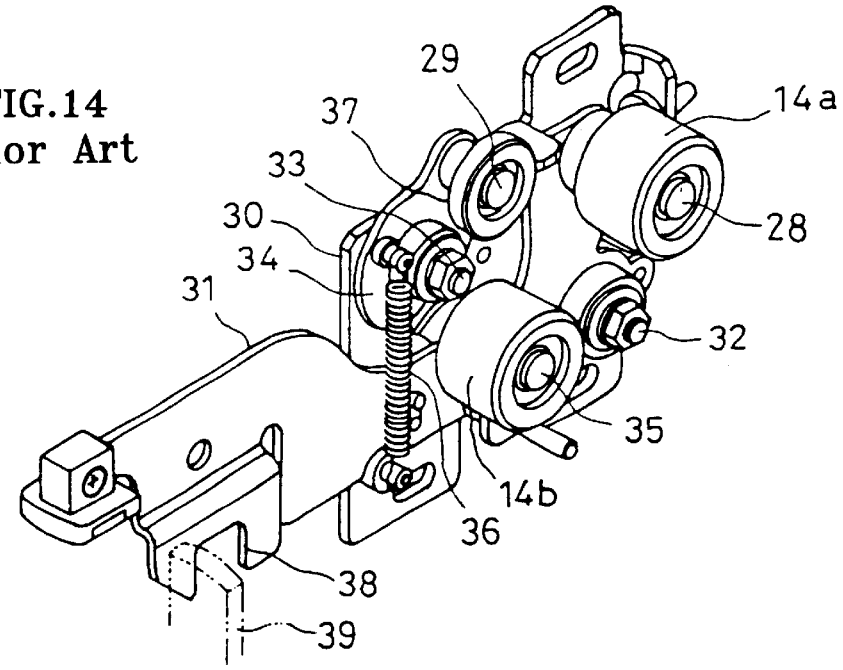
FIG.14 Prior Art
FIG. 14 is an oblique view illustrating prior art locking rollers.
Figure 15:
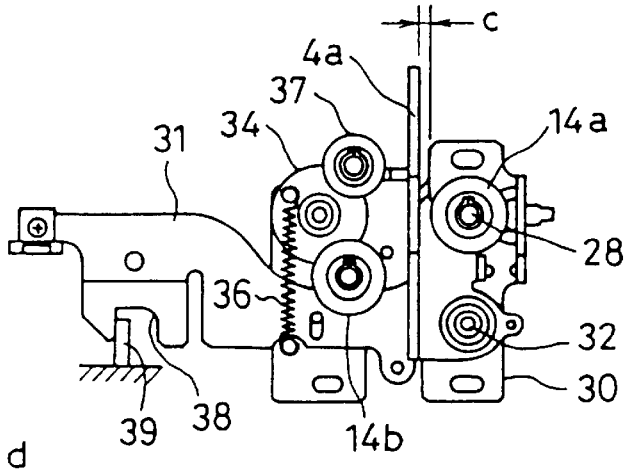
FIG.15 Prior Art
FIG. 15 is the front view of the prior art locking rollers.
Figure 16:
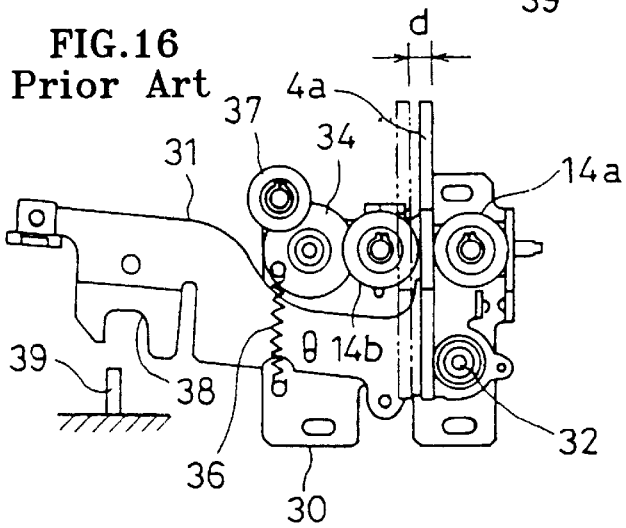
FIG.16 Prior Art
FIG. 16 is the operation front view of the prior art locking rollers.

As shown in FIG. 9, an L-shaped resin plate (51) may be fixed with an adhesive to the end part (4*a*) of the car cam, or as shown in FIG. 10, end part (4*a*) may be sandwiched by an L-shaped resin plate (52) which is fixed with screw (53). Said catch (50) hooks with said inclined surface (41), and the bottom of catch (50) can be bought into contact and engaged with the side surface of locking roller (14*b*).

Figure 3:
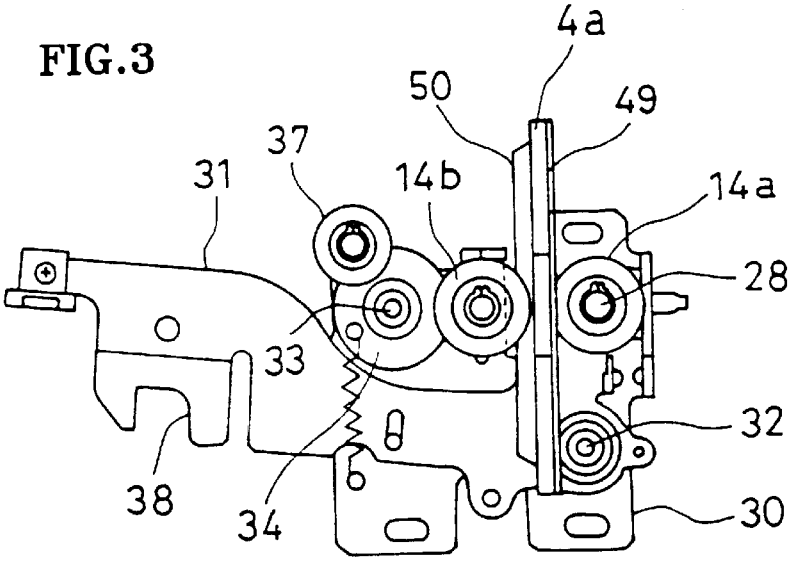
FIG. 3 is an operation front view of the elevator door apparatus.
Figure 6:
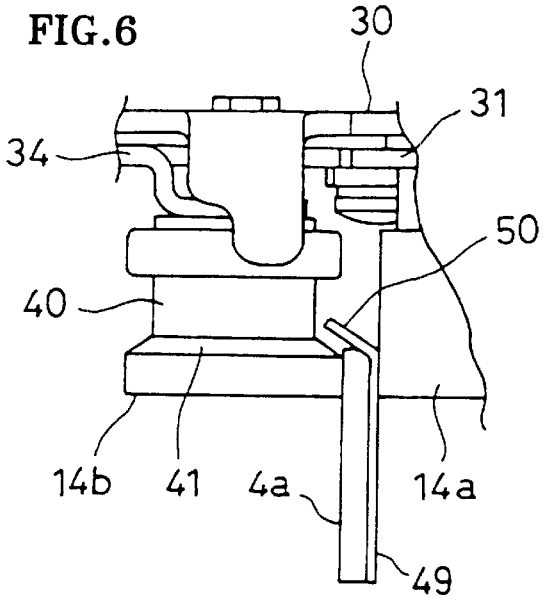
FIG. 6 is a partially enlarged view of FIG. 4.
Figure 7:
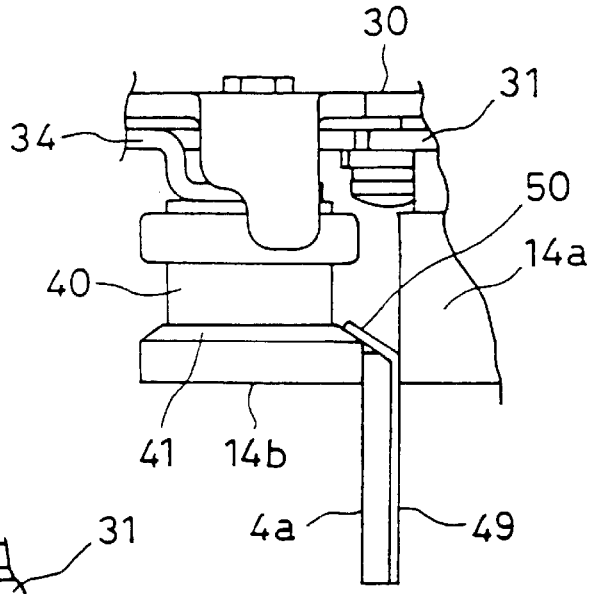
FIG. 7 is a partially enlarged operation view of FIG. 4.

Consequently, as shown in FIGS. 3 and 4, when end part (4*a*) of car cam (4) is bought into contact with locking roller (14*a*), door unlocking lever (31) is rotated around shaft (32), and locking recessed part (38) disengages from key (39). Also, when car cam (4) moves to press locking roller (14*a*), base bracket (30) starts to move, and disk (34), on which cam releasing roller (37) kicked by a projecting part formed on the opening/closing apparatus is installed, is rotated around shaft (33) under the force of spring (36). As a result, locking roller (14*b*) rotates to grip end part (4*a*) between itself and locking roller (14*a*). When locking roller (14*b*) is bought into contact with end part (4*a*) of car cam (4) which has come into contact with locking roller (14*a*), as shown in FIG. 6, a portion of catch (50) overhangs on the side of inclined surface (41) and is extended toward the side of step-shaped part (40) to be engaged. Therefore, even if car cam (4) moves in a direction away from locking roller (14*b*) as a result of vibration of the car, as shown in FIG. 7, since catch (50) is bought into contact with inclined surface (41)

to be fastened, the car cam will not easily slip out of the locking rollers.

As explained above, according to the present invention, since the car cam engaged with the locking rollers is not easy to slip out as a result of vibration of the elevator car, the boarding entrance door equipped with an automatic locking apparatus will not be suddenly closed when the boarding entrance door starts to open.

What is claimed is:

1. Elevator door apparatus used to start the opening and closing operation of the car door and the boarding entrance door by moving a forward end of a car cam furnished for the car door forward between first and second locking rollers furnished for the boarding entrance door so that said car cam nearly touches the first locking roller, while at the same time moving the second locking roller to grip the car cam, characterized by the fact that a step-shaped part is formed on the movable locking roller, and a catch which catches the step-shaped part is formed in the aforementioned car cam.

2. Elevator door apparatus described in claim 1 characterized by the fact that the catch is formed by obliquely bending an end of a metal plate superposed on the aforementioned car cam, whereby the end can make sliding contact with the step-shaped part.

3. Elevator door apparatus described in claim 1 characterized by the fact that the catch is formed by almost perpendicularly bending the end of a resin plate bonded to the end part of the aforementioned car cam, whereby the end of the resin plate can make sliding contact with the step-shaped part.

4. Elevator door apparatus as described in claim 1, characterized in that the step-shaped part of its one locking roller includes an inclined surface.

* * * * *